US005150979A

United States Patent [19]

Gallagher

[11] Patent Number: 5,150,979

[45] Date of Patent: Sep. 29, 1992

[54] BALL POINT PEN WITH LIQUID INK

[76] Inventor: Paul H. Gallagher, 2530 Crawford Ave., Evanston, Ill. 60201

[21] Appl. No.: 776,219

[22] Filed: Sep. 16, 1985

Related U.S. Application Data

[63] Continuation-in-part of Ser. No. 45,106. Jun. 4. 1979, abandoned.

[51] Int. Cl.[5] ..... B43K 7/10

[52] U.S. Cl. ..... 401/209; 401/216; 401/217; 401/219; 401/230

[58] Field of Search ..... 401/183, 184. 208–216, 401/217, 219, 222, 240, 230, 241, 232, 225, 135, 242, 236

[56] References Cited

U.S. PATENT DOCUMENTS

| | | | |
|---|---|---|---|
| 1.425.607 | 8/1922 | Rorison | 401/230 |
| 1.527.971 | 3/1925 | Forsell et al. | 401/216 |
| 2.332.771 | 10/1943 | Alstrom. Jr. | 401/184 |
| 2.435.123 | 1/1948 | Biro | 401/217 |
| 2.523.411 | 9/1950 | Bauer | 401/230 |
| 2.652.031 | 9/1953 | Reed | 401/217 |
| 2.669.223 | 2/1954 | Miessner | 401/241 X |
| 2.846.977 | 8/1958 | Aston | 401/184 |
| 2.847.975 | 8/1958 | Lawton | 401/217 |
| 2.880.702 | 4/1959 | Joyce | 401/209 |
| 2.911.949 | 11/1959 | Beckwith | 401/217 X |
| 2.931.339 | 4/1960 | Thomas | 401/183 |
| 3.537.801 | 11/1970 | Corte | 401/216 |
| 3.904.297 | 9/1975 | Hori | 401/216 |

FOREIGN PATENT DOCUMENTS

| | | | |
|---|---|---|---|
| 935653 | 11/1955 | Fed. Rep. of Germany | 401/230 |
| 1511403 | 6/1969 | Fed. Rep. of Germany | 401/209 |
| 976216 | 3/1951 | France | 401/217 |
| 1009193 | 5/1952 | France | 401/216 |
| 1072718 | 9/1954 | France | 401/217 |
| 1086340 | 2/1955 | France | 401/217 |
| 502544 | 11/1954 | Italy | 401/217 |
| 300627 | 8/1954 | Switzerland | 401/217 |

*Primary Examiner*—Steven A. Bratlie
*Attorney, Agent, or Firm*—Paul H. Gallagher

[57] ABSTRACT

A barrel, and a hollow cup-shape insert in the front end thereof, forming a capillary space between itself and the barrel. The insert has a closed front end, the tip portions of the insert and the barrel form a ball seat in which the writing ball is positioned, and the capillary space leads to the ball. The rear end of the insert is open and communicates with the main space in the rear portion of the barrel. A flexible bag is positioned in the rear of the barrel, for filling through a filler tube which constantly vents the interior. The main space in the rear portion of the barrel and that in the insert together form a single continuous space, substantially without internal obstruction. The ink is in the form of a main body of fluid, freely flowing, aqueous ink. When the pen is laid on its side, the body of ink communicates with the capillary space, filling it by capillarity action, and that ink feeds by capillary action to the ball. When the pen is held in front-end-down position, the main body of ink flows into the insert, and the ink in the capillary space is thereby free of the main body of fluid ink. When the pen is held in front-end-up position, the main body of ink flows to the rear end of the barrel, and the ink in the capillary space again is held by capillary action and flows by capillary action to the writing ball.

17 Claims, 2 Drawing Sheets

BALL POINT PEN WITH LIQUID INK

FIELD OF THE INVENTION

The invention resides in the main field of ball point pens and particularly such pens using liquid ink. Heretofore, the problems concerning such pens have not been overcome. A main problem concerns the very nature of liquid ink—because of its great fluency, it is difficult to confine and otherwise control. It is believed essential that the ink be controlled by capillary action, but it is difficult to control the passage of ink to the writing ball by capillary action and still maintain a body of free flowing ink to form a reserve, since such free flowing ink usually constitutes a relatively large body and would tend to destroy the capillary action.

Also, a common means resorted to in previous devices, consisted in a bundle of filaments that provided capillary spaces therebetween, but it was extremely difficult, if not impossible, to continue the capillary action to withdraw the ink from those spaces, after the ink passed thereinto from the reserve of ink.

Another means utilized in the past was pressure for forcing the ink to the writing ball, but this is considered unsuccessful.

PRIOR ART

There is no known prior art bearing on this invention.

OBJECTS OF THE INVENTION

A broad object of the invention is to provide a novel ball point pen that utilizes liquid or aqueous ink, and more particularly such with the following features and advantages:

(a) The pen has a main reservoir that holds a quantity of liquid ink, and means for positively feeding the ink to the writing ball by capillary action, so that there are no skips or failure of feed of the ink to the writing ball.

(b) The pen is constantly vented for facilitating feed of the ink to the writing ball, preventing locking of the feeding of the ink, but the special construction prevents flooding of the ink.

(c) The overall construction is extremely rugged and simple, eliminating most of the intricate and accurate details of construction heretofore required in writing pens.

(d) The capillary feeding means is capable of positively feeding ink to the writing ball in any position of the pen in writing, as on a horizontal upwardly facing surface (a desk), a vertical surface (a wall), or a horizontal downwardly facing surface (the ceiling), this positive feeding effect being accomplished with the ink not pressurized, but only under atmospheric pressure.

(e) The construction includes a barrel and an insert therein that is tubular/cup-shape at the forward end of the barrel, the insert and barrel forming an annular space therebetween of capillary dimension, the barrel and insert together forming a seat for the writing ball, and the capillary space leads to and terminates at the writing ball, the capillary space thereby positively feeding the ink to and into contact with the writing ball.

DESCRIPTION OF A PREFERRED EMBODIMENT

Figure 1:
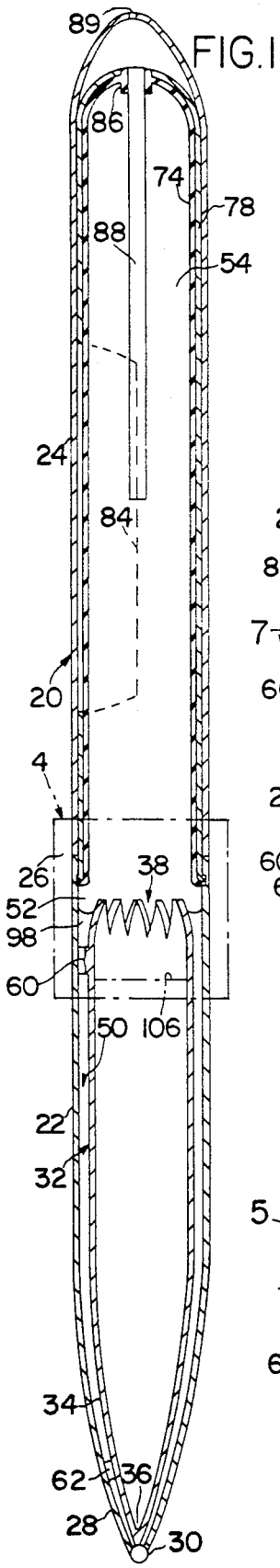
FIG. 1 is a longitudinal sectional view of the pen made according to the present invention.

Referring in detail to the drawings, FIG. 1 shows the entire pen of the invention in longitudinal sectional view, and includes all of the elements of the pen although certain of them in rather small scale, and attention is directed to other figures of the drawings for details of those elements.

As used herein, the writing point end of the pen may be referred to as the front end, as well as the lower end, because the pen is not limited to use in writing on a horizontal upwardly facing surface, as a desk, in which the front end may always be called the lower end, but in writing on other surfaces, that end may not always be the lower end, and hence its designation as the front end. Similarly the opposite end of the pen may be referred to as the rear end, as well as the upper end.

The materials of which the various parts of the pen are made, may be as desired according to presently known techniques, such as, plastic, rubber, metal, etc.

Figure 4:
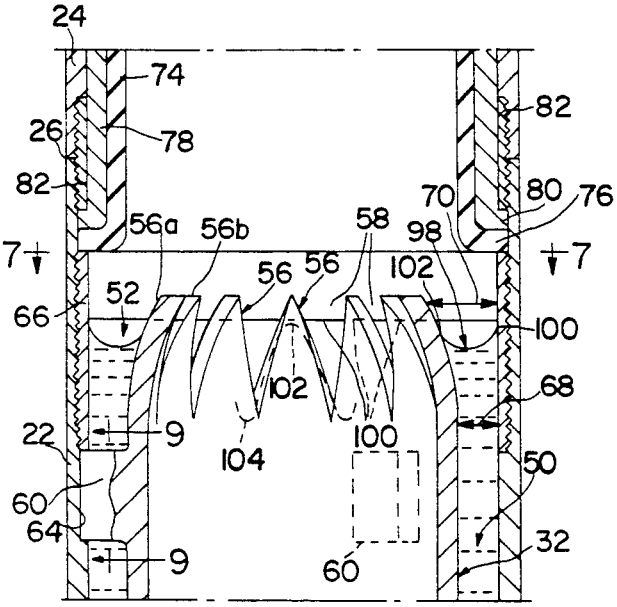
FIG. 4 is a large scale view of the portion of FIG. 1 enclosed in dot-dash lines and indicated at 4; this figure also is taken at line 4—4 of FIG. 7.

Referring to FIG. 1, the pen includes a barrel 20 made up of a front section 22 and a rear section 24 meeting at a parting line 26 (see also FIG. 4). The rear section 24 is threaded onto the front section and is easily removable by the user for filling purposes. The details of the threaded connection between the sections will be referred to hereinbelow.

The front section 22 tapers to a point 28 at its front end where a ball or writing point 30 is held in a manner described in detail hereinbelow.

Within the barrel, and specifically in the front section 22, is an insert 32 which is generally tubular, also tapering to a point at 34 conforming to the shape of the barrel section 22. This insert 32 is cup-shaped, closed at its lower end at 36 and open at its upper end at 38.

Figure 12:
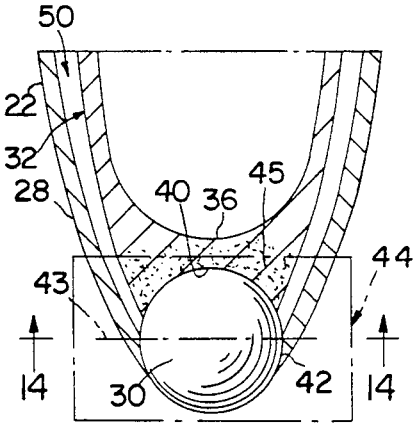
FIG. 12 is a large scale view of the lower end portion of FIG. 1 showing the writing ball and ball seat.
Figure 14:
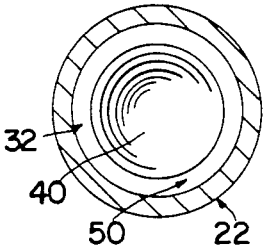
FIG. 14 is a view taken at line 14—14 of FIG. 12, but with the writing ball removed.

The lower end of the insert 32 has a concave surface 40 (FIGS. 12 and 14) forming a ball seat in which the writing ball 30 is disposed, and the point portion 28 of the lower barrel section partially surrounds the ball as indicated at 42, extending beyond the equator 43 thereof. The ball 30, the adjacent portion 42 of the barrel section, and the adjacent portion of the insert 32, together make up a unit 44 which for convenience will be referred to as a writing point unit. There are many kinds of writing point units on the market, and the present invention does not relate to a specific kind of those units except that it includes portions of the barrel section 22, and insert 32, and the ball. The lower end of the insert 32 may have particles of other material embedded therein as indicated by the stippling 45. This general kind of ball seat is known.

Figure 13:
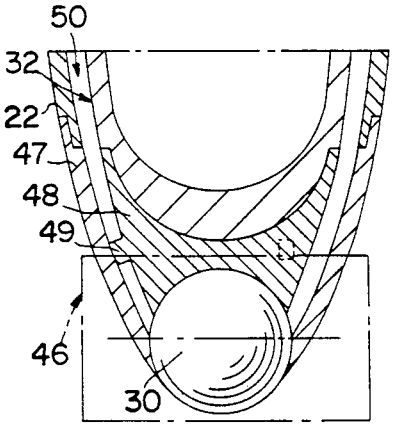
FIG. 13 is a view similar to FIG. 12 showing an alternate form of ball seat construction.

For a modified form of writing point unit, attention is directed to FIG. 13 which shows a unit 46 similar in shape to the unit 44 (FIG. 12), but instead of forming the ball seat from the barrel section and the insert, a separate ball seat may be used, which may be of metal. This ball seat construction may be of known kind, and includes a tip portion 47 forming an extension of the front barrel section 22 and a metal tip portion 48 fitted on the insert 32. Spacers 49 are provided on the tip portion 48, for engaging the inner surface of the tip portion 47, in a known manner.

The insert 32 (FIG. 1) with the barrel section 22, forms a capillary feed control space 50. This space is of capillary dimension, it is annular and is continuous from the writing ball 30 to adjacent the upper end of the insert where it leads into and communicates with a space 52 forming an extension thereof which is partially of capillary dimension but progresses to greater size of non-capillarity, as referred to in detail below. The space 52 communicates with the main internal space 54 of the pen. The capillary space 50 is of greatest capillarity at the front end, and decreases toward the rear end, this variation being produced by variation in radial dimension. This capillary space leads forwardly to and terminates at the writing ball 30, the writing ball thereby forming a closure element to the capillary space against the exterior. All portions of the ink as the ink is being fed to the ball, have the effect of drawing other, contiguous portions, so that the entire mass is fed positively and progressively to the ball. This action takes place in both the constructions of FIGS. 12 and 13, and in any case, the ink is fed to the ball by the space 50.

The capillary spaces herein are shown in greatly exaggerated dimensions. The actual dimensions of capillary spaces for lifting liquids to various heights, are well known, and therefore details of that phase are omitted from this description.

Figure 5:
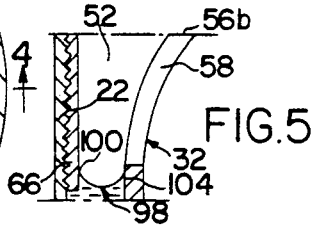
FIG. 5 is a sectional view taken at line 5—5 of FIG. 7.
Figure 6:
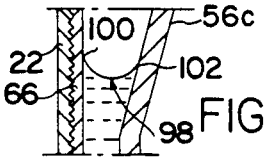
FIG. 6 is a view similar to FIG. 5, but showing a modified construction.

The rear end of the insert is serrated, having teeth or tangs 56 (FIG. 4), two of which are individually identified 56*a*, 56*b*, the teeth forming notches 58 therebetween. These teeth are inclined in toward the center, progressing in rearward direction, and may be arcuate as shown in FIGS. 4 and 5, or straight as in FIG. 6. In FIGS. 4 and 5 where the teeth are curved, capillary force decreases geometrically, while in FIG. 6 where the teeth are straight, the capillary force decreases linearly.

Figure 9:
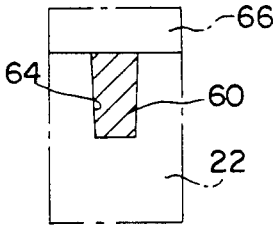
FIG. 9 is a view taken at line 9—9 of FIG. 4.

The insert 32 (FIG. 1) is held in centered position by suitable spacers 60 adjacent its rear end, and spacers 62 adjacent its front end, these spacers being provided in a suitable manner, such as projections formed on the insert, integral therewith. The spacers 60 extend into notches 64 (see FIG. 9) and are held therein in forward direction by a sleeve 66 (FIG. 4) which is externally threaded, and threaded in place in the corresponding portion of the barrel section 22 which is interiorly threaded at that location. The sleeve may be held in place by suitable cement, of known character and commonly utilized for normally preventing the user from removing it, but however enabling easy removal by a serviceman.

The rearward decrease in capillary force in the capillary space 50 is preferably gradual for the most part from the front end but that gradual variation in capillarity terminates rearwardly at a point indicated by the double headed arrow 68 (FIG. 4). The space 52, as indicated above, also decreases in capillary force rearwardly, this being produced by increase in radial dimension, this increase in radial dimension in turn being produced by the inclination of the teeth 56. This increase is abrupt so that the capillary force is lost between the arrow 68 and another double headed arrow 70 adjacent the rear end of the teeth. The purpose of this abrupt decrease in capillarity will be referred to again hereinbelow.

The capillary space 50 may be considered as being continuous, both longitudinally and circumferentially from the writing ball to the rear end of the insert, it being interrupted only by the spacers 60, 62, which occupy only a negligible portion of the total space. There is therefore continuity of feed or flow of the ink to the ball, there being no breaks therein.

Figure 2:
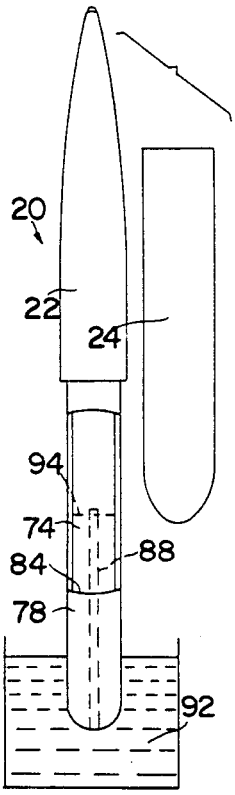
FIG. 2 is a small scale view of the pen inverted relative to FIG. 1 and showing it in filling position.

A flexible bag 74 is provided for filling the pen, this bag being of presently known kind, such as of rubber or rubber-like character, highly flexible. It has an outturned flange 76 (FIG. 4) at its front end and is substantially enclosed by a casing 78 which is relatively rigid and may be made of metal, or rigid plastic, this casing also having a flange 80. The flanges 80 and 76 are fitted together and held in place by another sleeve 82 which is externally threaded and threaded into the corresponding portion of the barrel and cemented in place similarly to the sleeve 66. The sleeve 82 however projects rearwardly beyond the front barrel section 22, and the rear barrel section 24 is threaded onto it. This rear barrel section, as noted above is freely removable by the user by merely threading it off of the sleeve 82. The casing 78 has a thumb hole 84 (FIGS. 1, 2) enabling the user to compress or collapse the bag for filling purposes.

Figure 8:
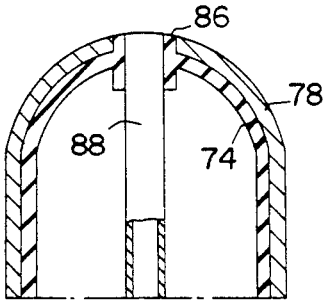
FIG. 8 is a large scale view of the upper end portion of FIG. 1 with the barrel section removed.

The bag 74 and casing 78 are rounded, such as spherically, at their rear end (FIGS. 1 and 8) and the bag has a central axial short sleeve 86, preferably integral therewith, in which is supported a filler tube 88. Preferably this sleeve 86 extends through an aperture in the casing 78 for rigidifying the assembly, the filler tube 88 being exposed to the exterior. The rear barrel section 24 has an aperture 89 (FIG. 1) which constantly vents the interior of the pen, this venting action proceeding through the filler tube 88.

Figure 10:
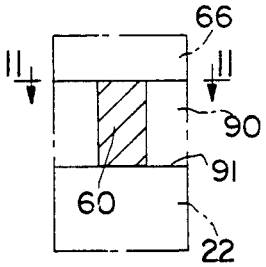
FIG. 10 is a view oriented similarly to FIG. 9 showing an alternate form of construction.
Figure 11:
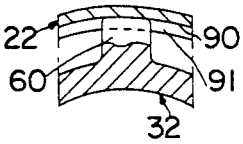
FIG. 11 is a view taken at line 11—11 of FIG. 10.

Locating the spacers 60 in the notches 64 (FIGS. 1 and 9) holds the insert 32 against rotational movement, but an alternate form may be used as shown in FIGS. 10 and 11. In the latter form, instead of the notches 64, the lower barrel section 32 is simply counterbored at 90 and the spacers are fitted against the shoulder 91 (see also FIG. 7) at the lower end of that counterbore, and the sleeve 66 is threaded down against the spacers. The frictional engagement against the spacers normally holds the insert against rotation.

For filling the pen, the user removes the rear barrel section 24 and inserts the rear end of the bag/casing 74, 78 (FIG. 2) into a body of ink 92 and compresses the bag and releases it, in a known manner. The ink, upon completion of the filling step, assumes a height indicated at 94, no higher than the top of the filler tube 88. The filler tube is of limited length for predetermining the amount of ink that can be drawn in, for a purpose to be referred to again hereinbelow. The pen has what will be termed an effective capacity for holding that amount of ink.

Figure 3:
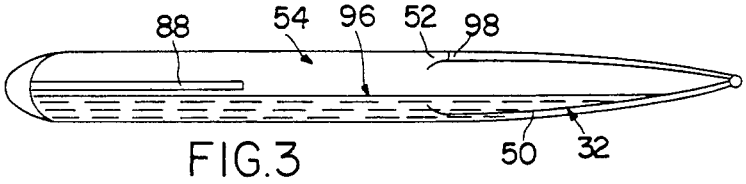
FIG. 3 is a semi-diagrammatic view of the pen lying in horizontal position.

When the pen has been thus filled, and laid on its side as represented in FIG. 3, the ink assumes a level 96 and this level is such that the ink will not flow out through the filler tube, the fact of there being a limited amount of ink, referred to sbove, accomplishing that result When the pen is in such horizontal position, the ink extends forwardly, but particularly into the space 52 leading to the capillary space 50. The capillary force of the space 50 is such that the ink proceeds by capillary action to completely fill the space, and it will at least cause the ink to flow to the then top of that space (FIG. 3) which is of course the diameter of the space and hence a small distance. However, the dimensions of the space 50 are preferably such that the capillary force will cause the ink to rise by capillary action the length of that space when it is in vertical position, to and above the position indicated by the arrow 68 (FIG. 4). Because of loss of capillarity at the upper end of the space 52, the ink is held up by the meniscus 98. This meniscus rises on the wall of the barrel as indicated at the point 100, and on the teeth 56 as indicated by the point 102. That portion of the ink in the space 54 of the reservoir that does not feed or progress into the space 52-50, flows through the notches 58 into the interior of the insert when the pen is moved to upright position. As a consequence, capillary force persists throughout the longitudinal extent of the ink in the space 50-52, this capillary force being manifested in the points 100, 102 of the meniscus reaching whatever points they will on the surfaces of the barrel and teeth. There is no portion at the rear end of the ink in the space 50-52 that is not under the influence of the capillary action and held thereby.

Figure 7:
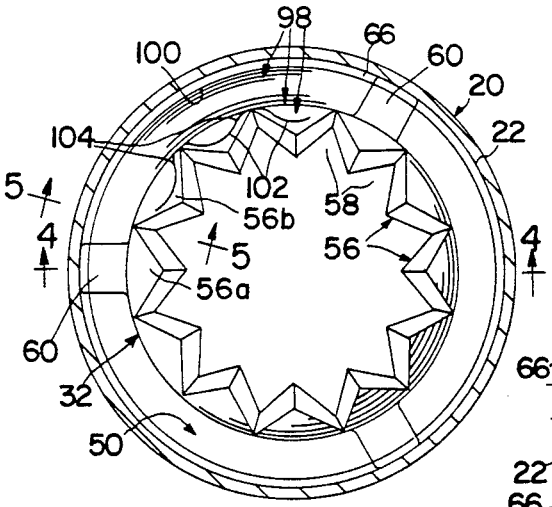
FIG. 7 is a view taken at line 7—7 of FIG. 4.

The meniscus 98, particularly at the radially inner portion thereof as represented by the points 102, may reach various heights on the teeth, and these points of course follow the conformation of the teeth/notches, and at the bottom of the notches they are represented by the line 104 (FIGS. 4 and 7). At the radially outer portion of the meniscus, the points 100 may not be uniformly positioned around the pen, but may vary somewhat according to their radial registration with the teeth or notches. Attention is directed to FIG. 5 which shows the second tooth **56*b* and the adjacent notch 58 in full view. In a position in registration with a notch, the inner edge of the meniscus is adjacent the lower end of the notch, at 104, while in a position in registration with a tooth, it rises at 1 to a greater height in engagement with the tooth (FIG. 4**).

The ball seat 40 itself is uninterrupted and continuous, the ink reaching the ball only in an annular area and not through the seat itself. In writing, the reaction pressure from the writing paper forces the ball against the seat 40, only, and there is no tendency for the ball to block or impede the flow of ink to the ball, since the ink as stated, in flowing to the ball, flows only through the annular space 50. None of the ink flows over or through the seat in its passage to the ball, and additionally, after the ink is applied to the ball, it is carried to the writing paper in direction away from the seat.

Figure 15:
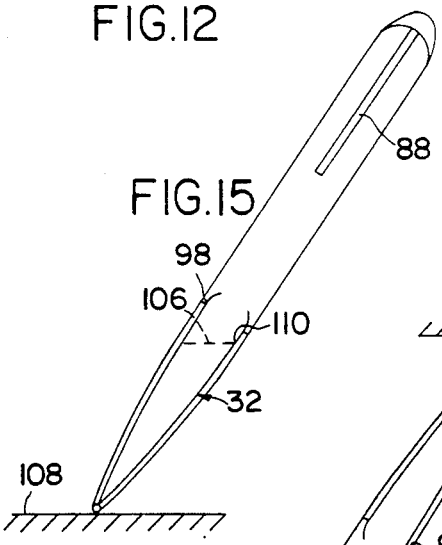
FIG. 15 is a small scale, semi-diagrammatic view of the pen in writing position on a horizontal surface such as a desk.

The predetermined length of the filler tube 88, referred to above, is such that the amount of ink taken into the pen in the filling operation, assumes a level 106 in the insert (FIG. 1) which is significantly below the rear or upper end of the insert, so that when the pen is held in position for writing on a desk 108 as in FIG. 15, the rearmost portion of the ink indicated at the point 110 is not above the lowermost point of those notches 58 that are then at the lower side of the pen.

Figure 16:
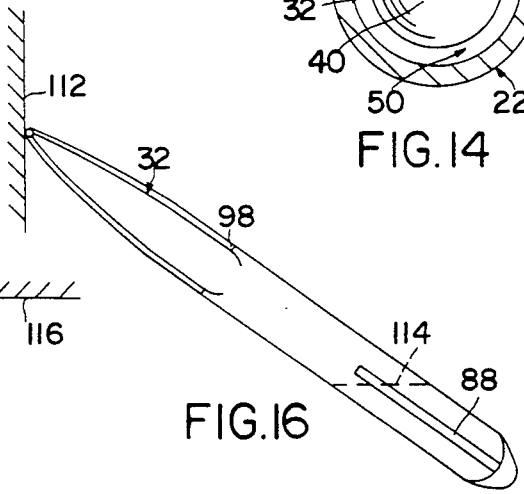
FIG. 16 is a semi-diagrammatic view of the pen in position writing on a vertical surface or the wall.

Because of the novel nature of the pen, it can be used for writing on a vertical surface, or wall, 112 as in FIG. 16. When holding the pen in such position, the body of ink, except that held in the capillary space 50, flows downwardly to the rear end of the pen and reaches a level indicated at 114. The main body of ink in the reservoir is thus removed from any effect on the ink in the capillary space, and the ink in that space is fed forwardly to the ball by capillary action. The increase in capillarity, as referred to above, leading forwardly, positively feeds the ink to and into engagement with the ball, and thus the capillary action forces the ink against the ball.

Figure 17:
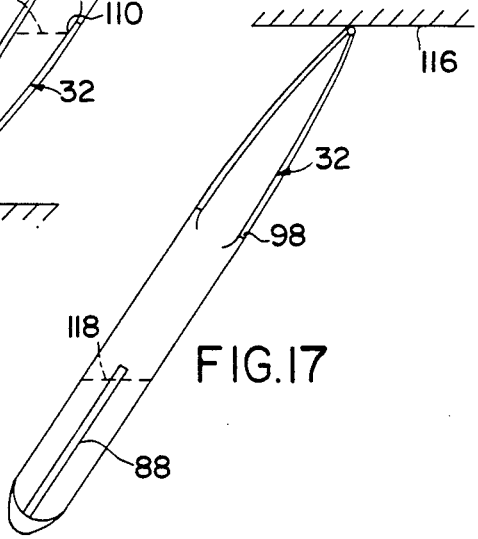
FIG. 17 is a semi-diagrammatic view of the pen in position writing on a downwardly facing surface, or the ceiling.

The pen is also effective for writing on a downwardly facing surface, the ceiling, 116 as represented in FIG. 17. When the pen is held in such position, the body of fluent ink flows downwardly to the rear end of the pen as indicated at the ink level 118. The body of fluent ink is therefore again removed from all influence on the ink held in the capillary space 50, and the capillarity of that space again is effective for positively feeding the ink upwwardly toward the front end of the pen, with full effectiveness in supplying ink to the writing ball. The action of the free flowing body of ink is the same in the writing positions of FIGS. 16 and 17 in that the body of free flowing ink resides at the rear end of the barrel and hence is entirely removed from influence on the ink in the capillary space.

The capillarity takes effect throughout the height of the capillary space 50 even though that space is not connected with a body or supply of ink at the bottom. For example, when the pen is positioned rear-end-down and the main body of the ink flows to the rear end at the bottom, the ink in the capillary space is held there by capillarity, and fed upwardly by capillarity to the ball.

The main space 54 (FIG. 1) in the rear portion of the barrel forms a main reservoir for the fluid ink in the pen. The interior space in the insert 32 forms a control reservoir serving not only to hold a supply of ink, but also to control it when the pen is in front-end-down position. The capillary space 50 can be considered a reservoir in a sense, because the supply of the ink therein, although not great in quantity, provides a supply for writing for a considerable period of time.

The overall construction of the pen, aside from the relative fineness of the ball and ball seat construction, is of very simple design, and rugged in nature. There are very few elements or components of the overall structure: the barrel (two parts), the insert, the ball, the flexible bag, the casing enclosing the bag, and the connecting sleeves (two). Thus an extremely simple structure results, and there is no requirement for unusual accuracy in dimensions such as are most times required in writing pen constructions. The dimensions of the capillary space 50 are of course important, but due to the fact that this space is formed by the wide-spread and smooth surfaces of the insert and barrel, that space can be made by properly shaping those surfaces, which is easily done because they are circular in cross-section and formed on long or relatively flat arcs longitudinally, and the desired characteristics of the capillary force are easily attained.

A great advantage resides in the simplicity of the capillary space 50. This space is formed by only two elements, the surfaces of the insert 32 and barrel section 22 and these are of extremely great area, providing extensive and uninterrupted capillary space and quantity of ink. At any position in the capillary space 50 along the length of the pen, the capillarity is uniform in transverse direction. This is in great contrast to such construction as filaments and similar elements where the capillary spaces vary widely in direction transversely. All portions of the capillary space are continuous and all of the ink in that space forms a continuous uniform body on which the capillary force acts uniformly.

A further advantage is that the upper end of the capillary space 50 can be substantially greater in radial direction than the minimum requirement so that the space can be decreased forwardly at an extremely greater rate, to correspondingly greatly increase the capillary action in feeding the ink forwardly through that space. It is to be noted however that the invention is of such board scope to include uniform capillarity longitudinally of the space if such should for any reason be desired.

I claim:

1. A writing pen comprising, a barrel having a front end and an aperture in the front end and a writing ball operatively mounted in the aperture, the barrel having a constantly rear-end vented reservoir constituted by an essentially open-space interior, and enabling free movement of the ink therein, means for filling the barrel to a pre-determined effective capacity with aqueous ink, control means forming a capillary space operative for receiving ink from the main reservoir and holding it therein by capillary action, and feeding it by capillary action to the writing ball, and that capillary space constituting the only communication between the reservoir and writing ball, and the control means being operative, when the writing pen is in front-end-down position, for confining all ink in the barrel, except that in the capillary space, and holding it separated from and out of contact with or continuity with the ink in the capillary space, and holding it against bearing on or having any action or influence on the writing ball or capillary space, whereby when the writing pen is in that position, only the ink in the capillary space has communication with the writing ball, the capillary space being so positioned that, when the writing pen is adjacent horizontal position, the ink in the main reservoir has communication with the capillary space, and flows thereinto by capillary action.

2. A writing pen according to claim 1 wherein, the control means is operative, when the writing pen is in front-end-up position, for holding ink in the capillary space, and positively feeding it forwardly in upwardly direction by capillary action to the writing ball, while the ink in the main reservoir recedes downwardly to the rear end of the barrel, whereby to enable the writing pen to write on a vertical surface (a wall) or on a downwardly facing surface (the ceiling).

3. A writing pen comprising, a barrel having a front end and an aperture in the front end and a writing ball operatively mounted in the aperture, the barrel having a constantly vented main reservoir constituted by an essentially open-space interior, and enabling free movement of ink therein, means for filling the barrel to a pre-determined effective capacity with aqueous ink, control means forming a capillary space operative for receiving ink from the main reservoir and holding it therein by capillary action, and feeding it by capillary action to the writing ball, and the control means being operative, when the writing pen is in front-end-down position, for confining all ink in the barrel, except that in the capillary space, and holding it separated from and out of contact with or continuity with the ink in the capillary space, and holding it against bearing on or having any action or influence on the writing ball or capillary space, whereby when the writing pen is in that position, only the ink in the capillary space has communication with the writing ball, the control means including an insert in the front end portion of the barrel and has a front end adjacent the front end of the barrel, the insert defining said capillary space between itself and the barrel and the capillary space communicating with said aperture, and leading therefrom rearwardly to and communicating with the main reservoir in the barrel, the insert having a closed front end, and being hollow and defining an interior space which communicates rearwardly with the main reservoir in the barrel, the insert being capable of receiving the ink from the main reservoir and thereby constituting the means for so holding it.

4. A writing pen according to claim 3 wherein, the volume of the interior space of the insert is so dimensionally related to said effective capacity that the quantity of ink of said effective capacity is not more than that of the interior space of the insert, whereby when the pen is put in front-end-down position, all ink in the pen in excess of that in said capillary space will flow into the insert.

5. A writing pen according to claim 3 wherein, the capillary space is free of interior obstructions and continuous in annular tubular form, to the extent possible with minimum elements between the insert and the barrel only necessary for positioning the insert in the barrel, decreasing in dimension in radial direction and thereby increasing in capillarity progressing forwardly the full length of the insert and leading to and terminating at the writing ball whereby the capillary action is operable for positively forcing the ink to the writing ball.

6. A writing pen according to claim 3 wherein, the capillary space terminates rearwardly in a space that is greater than capillary dimension, for a height represented by the length of the insert.

7. A writing pen according to claim 6 wherein, the rear end of the insert is serrated, providing notches enabling ink in the main reservoir, when the pen is in front-end-down position, to run into the insert, and teeth between the notches, the teeth and barrel together forming a continuation of the capillary space rearwardly to a position beyond the bottom of the notches, and the space between the teeth and barrel increasing rearwardly and progressing into said greater than capillary dimension.

8. A writing pen according to claim 3 wherein, the capillary space is annular in shape surrounding the central axis of the writing pen, and it is of uniform dimension transversely at every position around the axis at every location longitudinally of the writing pen.

9. A writing pen according to claim 8 wherein, the insert and the barrel have opposed surfaces, forming the capillary space, that are continuous, smooth and regular throughout the dimensions of the capillary space, except for minimum elements only necessary for positioning the insert in the barrel.

10. A writing pen according to claim 4 wherein, the writing pen includes a flexible bag in the rear end portion thereof and a filler tube in the bag and extending through the rear end of the bag to the exterior, the writing pen is filled by inserting the rear end of the bag into a supply of ink and collapsing and releasing the bag, and the filler tube is pre-dimensioned to effect filling the main reservoir to its said effective capacity.

11. A writing pen according to claim 3 wherein, the insert is provided with a ball seat at its front end in register with said aperture, the writing ball is disposed in said ball seat and held therein by an adjacent portion of the barrel, said capillary space terminates at the ball in an annular area.

12. A writing pen according to claim 11 wherein, the central portion of the ball seat within said annular area is continuous and imperforate, and the communication of the capillary space is in said annular area to the exclusion of said central portion and the portion of the ball that is within the annular area.

13. A writing pen according to claim 9 wherein, the capillary space decreases in circumferential dimension proceeding forwardly of the writing pen toward the writing ball.

14. A writing pen comprising, a barrel having a front end and an aperture in the front end and a writing ball operatively mounted in the aperture, the barrel having a constantly vented main reservoir constituted by an essentially open-space interior, and enabling free movement of ink therein, means for filling the barrel to a pre-determined effective capacity with aqueous ink, control means forming a capillary space operative for receiving ink from the main reservoir and holding it therein by capillary action, and feeding it by capillary action to the writing ball, and the control means being operative, when the writing pen is in front-end-down position, for confining all ink in the barrel, except that in the capillary space, and holding it separated from and out of contact with or continuity with the ink in the capillary space, and holding it against bearing on or having any action or influence on the writing ball or capillary space, whereby when the writing pen is in that position, only the ink in the capillary space has communication with the writing ball said capillary space being formed only by opposed broad-surface walls to the exclusion of capillary-forming elements in the space, and the space being entirely a void except for elements necessary for spacing the walls apart.

15. Writing pen comprising, a barrel having a writing ball operably mounted in a front end for engaging a writing surface, the barrel having a main reservoir of greater-than-capillary dimension enabling liquid ink therein to flow freely in any direction, means for filling the barrel to a pre-determined effective capacity with aqueous ink, means constantly venting the reservoir to atmosphere, the control means forming a control reservoir, the control means also forming a capillary space communicating between the main reservoir and the writing ball, and that capillary space constituting the only communication between the main reservoir and the writing ball, the control means, (a) being so positioned that, when the main reservoir contains ink and that ink reaches the capillary space, the capillary space is effective for feeding the ink by capillary action from the main reservoir into the capillary space, and thereafter (b) being operable for feeding ink in the capillary space by capillary action to the writing ball, and further (c) being so positioned that, in any point-end-down position of the pen, the capillary space opens upwardly and at its then upper end communicates with the main reservoir, and (d) being so positioned that the control reservoir, when the pen is in point-end-down position, is capable of receiving all ink in the main reservoir, and thereafter is operable preventing any ink from entering into, or moving to, the capillary space.

16. A writing pen according to claim 15 wherein, the capillary means increases in capillarity in direction from the reservoir to the writing ball.

17. A writing pen comprising, a barrel having a front end and an aperture in the front end and a writing ball operatively mounted in the aperture, the barrel having a constantly vented main reservoir constituted by an essentially open-spaced interior, and enabling free movement of ink therein, means for filling the barrel to a pre-determined effective capacity with aqueous ink, control means forming a capillary space operative for receiving ink from the main reservoir and holding it therein by capillary action, and feeding it by capillary action to the writing ball, the control means being operable, when the writing pen is in horizontal position, for establishing liquid continuity from the ink in the reservoir to the capillary space, and the control means being operative, when the writing pen is in front-end-down position, for confining all ink in the barrel, except that in the capillary space, to the extent of said effective capacity, and holding it separated from and out of contact with or continuity with the ink in the capillary space, and holding it against bearing on or having any action or influence on the writing ball or capillary space, whereby when the writing pen is in that position, only the ink in the capillary space has communication with the writing ball.

* * * * *